US006688757B2

(12) United States Patent
Kovach et al.

(10) Patent No.: US 6,688,757 B2
(45) Date of Patent: Feb. 10, 2004

(54) HID LAMP WITH COLLAPSIBLE REFLECTOR

(75) Inventors: Jeremy J. Kovach, Arden, NC (US); Gary A. Steinberg, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,836

(22) Filed: Oct. 23, 2001

(65) Prior Publication Data

US 2003/0076668 A1 Apr. 24, 2003

(51) Int. Cl.[7] ..... F21V 7/18

(52) U.S. Cl. ..... 362/352; 362/278; 362/350; 362/450

(58) Field of Search ..... 362/278, 350, 362/352, 257, 277, 296, 297, 304, 306, 310, 311, 317, 341, 346, 347, 351, 353, 358, 450, 382, 433, 280, 281, 323; 359/353, 515, 546, 838, 871; D26/72, 85, 24, 103, 113, 118

(56) References Cited

U.S. PATENT DOCUMENTS

| | | | | | |
|---|---|---|---|---|---|
| 86,987 | A | * | 2/1869 | Laws | 362/360 |
| 1,196,523 | A | * | 8/1916 | Clark | 362/352 |
| 1,813,102 | A | * | 7/1931 | Vogel | 362/322 |
| 2,513,961 | A | * | 6/1950 | Ostrom | 362/352 |
| 2,586,583 | A | * | 2/1952 | Wagner | 362/350 |
| 2,625,648 | A | * | 1/1953 | Zenda | 362/352 |
| 2,796,517 | A | * | 6/1957 | Herzfelder | 362/352 |
| 3,040,994 | A | * | 6/1962 | Anderson et al. | 362/346 |
| 4,061,913 | A | * | 12/1977 | Ross | 362/352 |
| 4,118,763 | A | | 10/1978 | Osteen | 362/339 |
| 4,167,034 | A | * | 9/1979 | Noguchi | 362/352 |
| 4,285,034 | A | * | 8/1981 | Sullivan | 362/350 |
| 4,594,645 | A | * | 6/1986 | Terashita | 362/352 |
| 4,628,423 | A | * | 12/1986 | Ogle | 362/341 |
| 4,654,767 | A | * | 3/1987 | Yamaguchi | 362/352 |
| 4,839,781 | A | | 6/1989 | Barnes et al. | 362/299 |
| 4,855,884 | A | * | 8/1989 | Richardson | 362/278 |
| 4,998,189 | A | * | 3/1991 | Guggemos | 362/278 |
| 5,036,445 | A | | 7/1991 | Osteen | 362/348 |
| 5,287,259 | A | * | 2/1994 | Lautzenheiser | 362/352 |
| 5,329,438 | A | * | 7/1994 | Thompson | 362/350 |
| 5,571,280 | A | * | 11/1996 | Lehrer | 362/352 |
| 5,579,180 | A | | 11/1996 | Geller | 359/847 |
| 5,662,412 | A | * | 9/1997 | Glendmyer | 362/352 |
| 6,024,469 | A | * | 2/2000 | Greif | 362/350 |
| 6,030,087 | A | * | 2/2000 | Whittle | 362/352 |
| 6,206,551 | B1 | * | 3/2001 | Stubblefield, Jr. | 362/352 |

FOREIGN PATENT DOCUMENTS

| | | | |
|---|---|---|---|
| EP | 0597199 A1 | 11/1992 | F21V/7/18 |
| EP | 0964291 A1 | 12/1999 | G03B/15/06 |

* cited by examiner

*Primary Examiner*—Alan Cariaso
*Assistant Examiner*—Ismael Negron
(74) *Attorney, Agent, or Firm*—Fay, Sharpe, Fagan, Minnich & McKee, LLP

(57) ABSTRACT

A high lumen output illumination device includes a light source secured on a ballast housing and a reflector. At least one reflective element redirects light emanating from the source along a direction of interest. At least one support element gives the reflective element a useful optical shape and aids in the retention of the optical shape. The reflector is capable of being transitioned between two orientations, an open orientation, where the reflector is functional, and a collapsed orientation, where the reflector occupies a greatly reduced amount of space. The reflector includes a fastening means that allows the reflector to be removed from the ballast housing, and re-attached to the ballast housing when desired.

11 Claims, 8 Drawing Sheets

HID LAMP WITH COLLAPSIBLE REFLECTOR

BACKGROUND OF INVENTION

The present application relates to the artificial illumination arts. It finds particular application in high lumen output luminaries that include reflectors which are packaged and shipped and will be described with particular reference thereto. It is to be appreciated, however, that the present application is not limited to the aforementioned application.

Typical reflectors used in conjunction with high intensity discharge (HID) lamps are bulky constructions, consuming space, yet having an actual volume that is relatively small. The shape of a reflector is often dictated by required optical characteristics, rather than size and shape requirements. As a result, bulky reflectors are often desired, and it is necessary to ship the bulky reflectors to the consumer. Packaging a reflector often involves putting the reflector in a box, the box being a standard shipping means. Since the box and the reflector are such different shapes, and the box must be big enough so the reflector can fit inside, much of the room in the box is unoccupied, making shipment of an assembled reflector in a box rather inefficient.

One known alternative is to ship the reflector in disassembled sections, reducing the amount of empty space in a packaging box. While this method holds the advantage of making more efficient use of packaging space, the reflectors require assembly upon arrival to the consumer. Either the consumer assembles the reflectors, or the retailer employs personnel to assemble the reflectors upon arrival to the consumer.

Umbersols such as the type used in photography flash fixtures, and described in EP 0 964 291 A1 to Whittle utilize collapsible reflectors. This type of reflector includes a sheet of reflector element that is supported by a plurality of legs. This type of reflector is typically assembled and disassembled before and after each use, the legs being folded or removed from the light socket. Moreover, this type of reflector is used in conjunction with a low average wattage lamp, making its use with HID light fixtures improbable.

SUMMARY OF INVENTION

In accordance with one aspect of the present invention, a lighting fixture is provided. A light source is fixed onto a ballast housing. A collapsible reflector is fixedly attached to the ballast housing with at least one fastener. At least one reflective element focuses and directs light emanating from the light source, and at least one support element aids in the retention of an optically useful shape of the reflective element.

In accordance with another aspect of the present invention, a method of packaging a reflector is provided. The reflector is collapsed into a form that occupies less space than its expanded form. The reflector is inserted into a shipping medium in its collapsed form, there being substantial room left in the shipping medium.

BRIEF DESCRIPTION OF DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION

Figure 1:
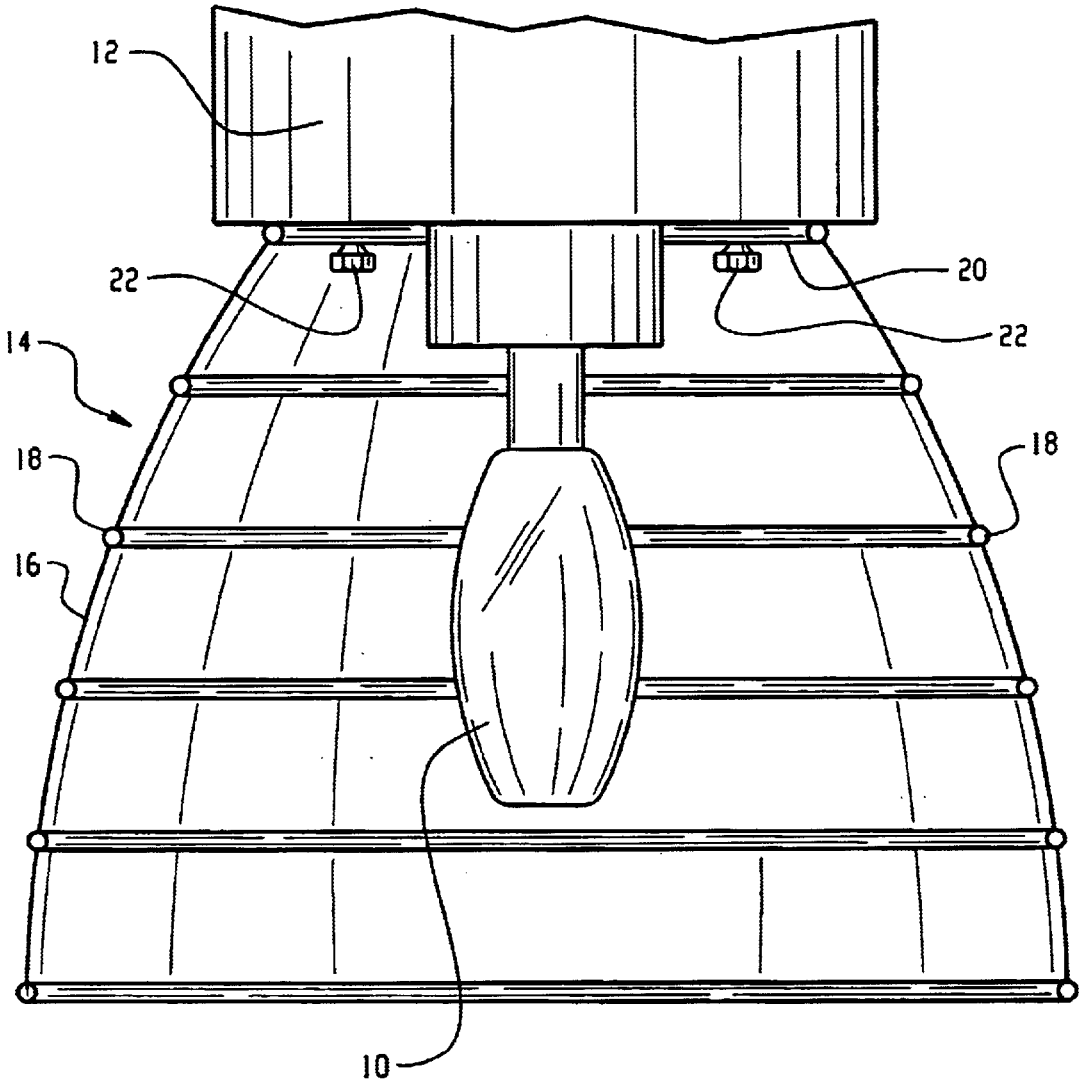
FIG. 1 is a cross sectional view of a concentric ring embodiment of an HID reflector, in accordance with one aspect of the present invention.

With reference to FIG. 1, a light source 10 is mounted on a ballast housing 12. A collapsible reflector 14 focuses and re-directs light emanating from the light source. A reflective element 16 is supported by a plurality of support elements. The support elements are concentric rings 18 that are smaller in radius near the ballast housing 12, and larger in radius extending downward away from the ballast housing 12. Preferably, the ballast housing is mounted vertically with respect to ground so gravity naturally extends the reflector 14 away from the ballast housing 12. Alternately, the ballast housing 12 can be mounted in an orientation other than vertical and additional securements used to hold the reflector 14 in its extended position.

The reflective element 16 is preferably a flexible material, such as a heat resistant material with a reflective coating applied. Thin sheets of reflective plastics such as Mylar, Polyimide, Kapton, and Teflon are preferred. In general, the reflective element 16 is a material that can be manufactured in the form of a sheet, is flexible, and can be coated or is inherently reflective. The reflective element is secured to the rings 18 such that the reflective element 16 is extended to the same orientation each time the rings 18 are extended. One preferred method of securing the rings 18 is to laminate them within the reflective element. Two layers of reflective material are fused around the rings 18, by heating, or other adhesive means well known in the art. Another preferred method is securing the rings 18 to the reflective element 16 using an additional bonding agent or adhesive. The rings 18 could be either inside or outside of the reflective element 16 with respect to the light source 10.

The reflector 14 is collapsible to occupy less volume. The rings 18 are stacked forming a "bull's eye" orientation in a single plane. The reflective element 16 folds into the spaces between the rings 18. The reflector 14 can remain attached to the ballast housing 12 when compressed, or it can be removed and stored separately. The reflector 14 is preferably fixedly attached to the ballast housing. Inscribed within and attached to the uppermost ring is a base plate 20, which is used to attach the reflector 14 to the ballast housing 12. The base plate 20 includes a large central aperture through which the light source 10 is fixed to the ballast housing 12. The base plate also includes a plurality of generally keyhole shaped apertures that fit over an equal number of bolts 22 in the ballast housing 12. The reflector 14 is twisted slightly such that the bolt shafts fit into the narrow portions of the keyhole shaped apertures. The bolts 22 are then tightened to secure the reflector 14 in place relative to the ballast housing 12. Alternately, the base plate 20 may be bolted directly to the ballast housing.

In a variation of the above disclosed embodiment, the support is a single helical construction rather than a plurality of concentric rings. In this variation, the support can be biased to the open position so the lighting fixture can be oriented in a position other than vertical. Additionally, a locking mechanism or clamp is included to keep the reflector in a collapsed position, as it would tend to open.

Figure 2:
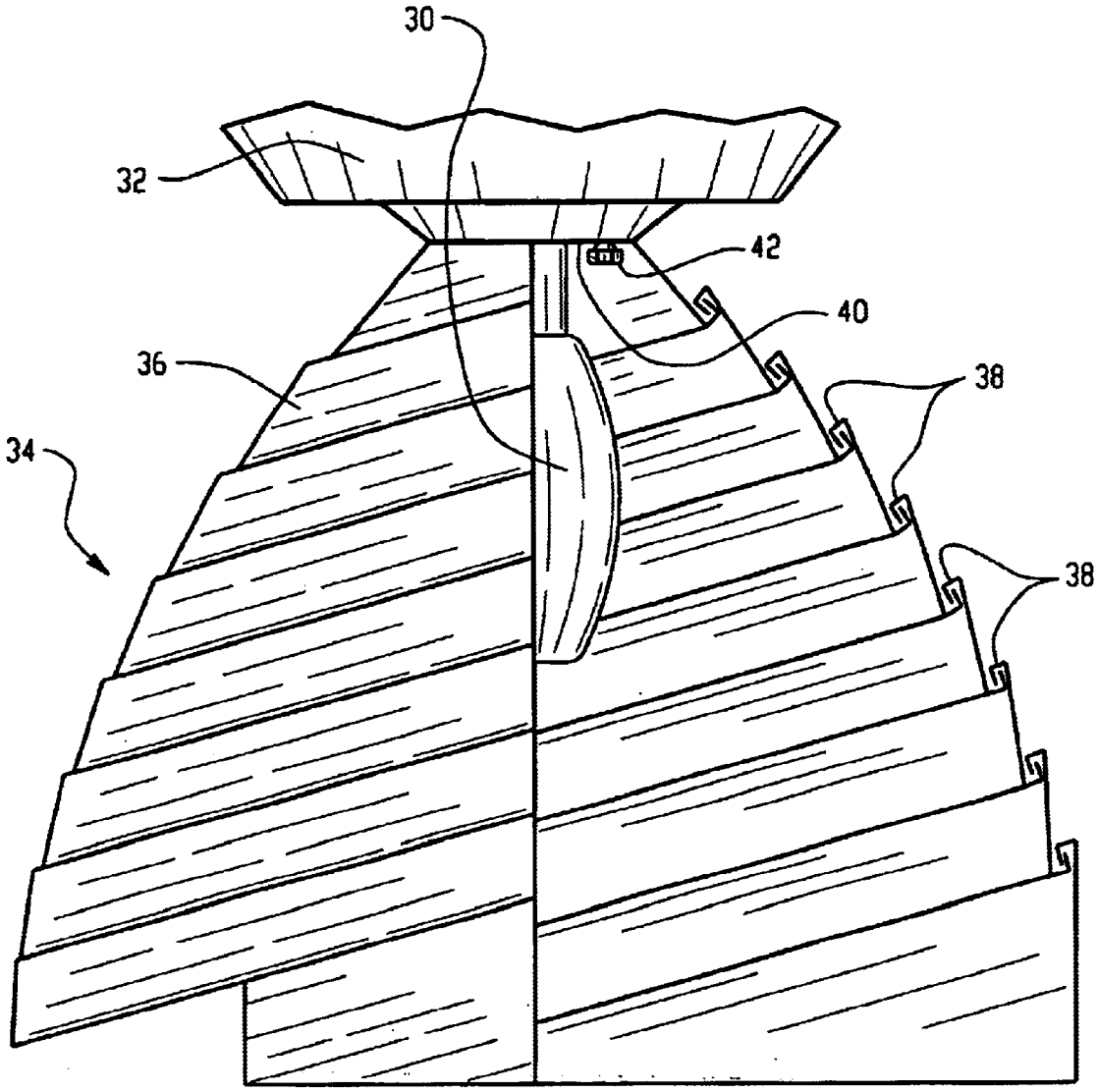
FIG. 2 is a sectional view of a spirally wound embodiment of the HID reflector, in accordance with one aspect of the present invention.

In an alternate embodiment, and with reference to FIG. 2 a light source 30 is carried on a ballast housing 32. A reflector 34 focuses and re-directs light emanating from the light source. A reflective element 36 includes a thin, elongated strip that is coiled in a spiral, forming a desirable optical shape of the reflector 34. Transverse edges of the reflective element 36 include support elements 38 that aid the reflective element 36 in retaining its optical shape. The preferred support elements 38 are interlocking hooks made from the edges of the reflective element 36 that have been folded over. The reflective element 36 is biased toward an open position, and the support elements 38 prevent the reflective element 36 from over extending. To achieve a collapsed position, pressure is applied to the reflector, (in an upward direction in FIG. 2,) compressing the helical shape into a spiral. Preferably, a latch or other locking device holds the reflector in the collapsed form. Alternately, rather than a single helical strip, a plurality of helical strips can be utilized to form the reflector.

The uppermost portion of the reflector 34 includes a flange portion 40 by which the reflector 34 is secured to the ballast housing 32. Screws, rivets, interlocking tabs, or other well known securing devices 42 are used to hold the flange portion 40 secure relative to the ballast housing 32. Simple, non-permanent attachment means are preferred to permanent attachment means to allow the ballast housing 32 and the reflector 34 to be shipped as one unit, or separately, depending the needs and desires of the consumer. Optionally, the reflector can be flangeless, with portions of the reflective element 36 secured to the ballast housing 32.

The reflective element 36 is preferably biased to the open, extended orientation, that is, helical reflective element 36 acts much like a spring. Thus, the reflector may be positioned in orientations other than vertical with respect to the ground. However, the preferred bias is not so great to render collapsing the reflector difficult. The hooks 38 are preferably made utilizing a roll-forming method, or other well known, equivalent machining method. The reflective element is preferably constructed of aluminum, steel, or any material having a 'shape memory' that can be finished with a reflective coat. The interior portion of the reflective element 36 used for reflection is preferably finished with a high reflectance mirror surface or other useful optical finish, such as a high reflectance matte, white glossy paint, or a semi-bright finish. Ultimately, the reflective finish depends on the desired application. The reflective element 36 is preferably between 0.5 and 1.0 mm thick, to provide the reflective element 36 with the needed flexibility to comfortably transition between open and closed reflector orientations.

Figure 3:
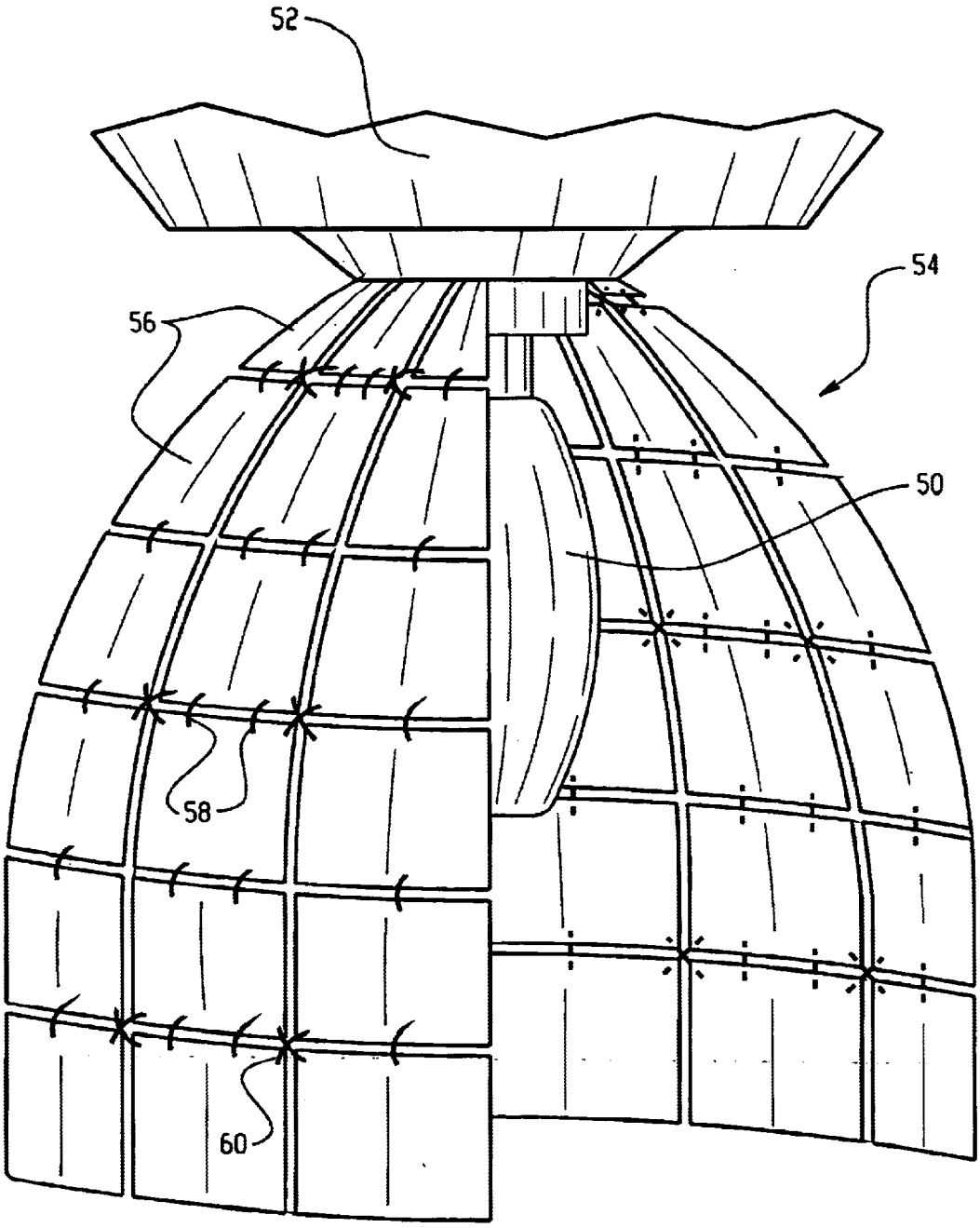
FIG. 3 is a sectional view of a plate mail embodiment of the HID reflector, in accordance with one aspect of the present invention.

In an alternate embodiment of the present invention, and with reference to FIG. 3, a light source 50 is carried on a ballast housing 52. A reflector 54 includes a plurality of reflective elements 56 that are held in position with respect to one another with support elements. The reflective elements 56 are plates having reflective surfaces facing inward towards the light source. The reflective elements 56 are shaped according to their position in the reflector 54. The reflective elements 56 are arranged in tiers, each tier forming a horizontal zone, there being six shown in FIG. 3.

Along horizontal intersections of the reflective elements, that is, the horizontal barriers between zones, horizontal hinges 58 secure the vertical positions of the various zones relative to each other. Control hinges 60 secure radial positions, that is, distance from the light source 50, of the reflective elements. In a six zone embodiment as depicted in FIG. 3, three sets of control hinges 60 are utilized. One set is between the first and second zones, a second set is between the third and fourth zones, and a third set is between the fifth and sixth zones. The control hinges are preferably used between every other zone to allow collapsibility of the reflector 54. In the preferred embodiment, the reflective elements 56 fold onto one another, the horizontal zone intersections with control hinges folding away from the light source, and the zone intersections without control hinges folding towards the light source 50. Preferably, gravity is used to keep the reflector 54 in an open orientation when the light source 50 is in operation. Alternately, latches at the intersections are utilized to keep the reflector 54 in an open orientation so the light source 50 may be oriented other than vertical with respect to the ground.

The reflective elements 56 are preferably pre-formed polyhedral constructions that are coated with a useful optical coating on their interior faces. Trapezoidal reflective elements are preferred, but any polyhedral sections that form a useful optical shape are possible. The horizontal hinges 58 can be separate hinges, or they can be integrated within the reflective elements. In a separate hinge embodiment, apertures are provided in the reflective elements to accept the hinges. In an integral hinge embodiment, alternating edges are equipped with hinges 58, while the edges adjacent to the hinges are provided with apertures to accept the hinges. Similarly, either integral or separate control hinges could be used.

Figure 4:
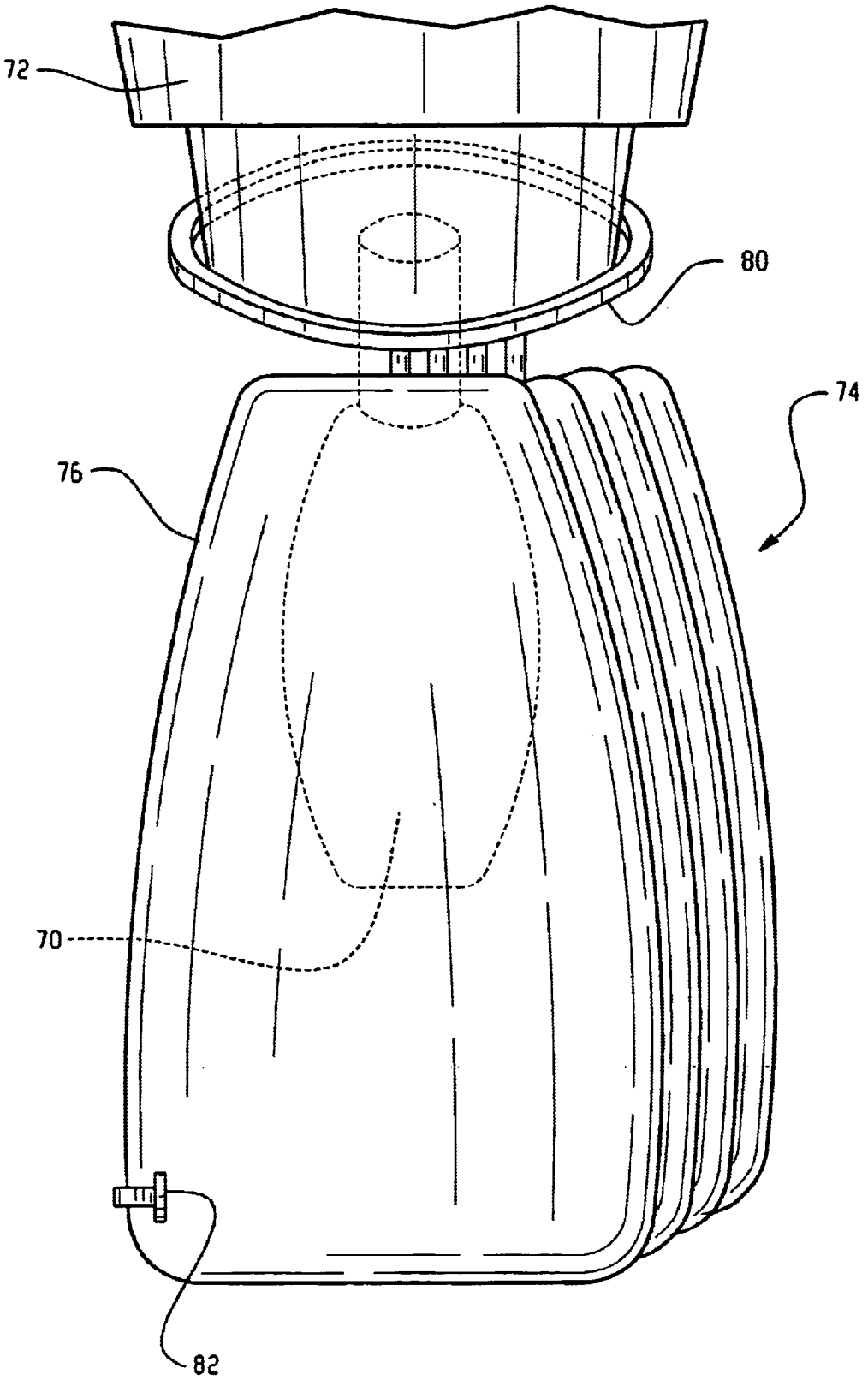
FIG. 4 is a collapsed view of a stacked plate embodiment, in accordance with one aspect of the present invention.
Figure 5:
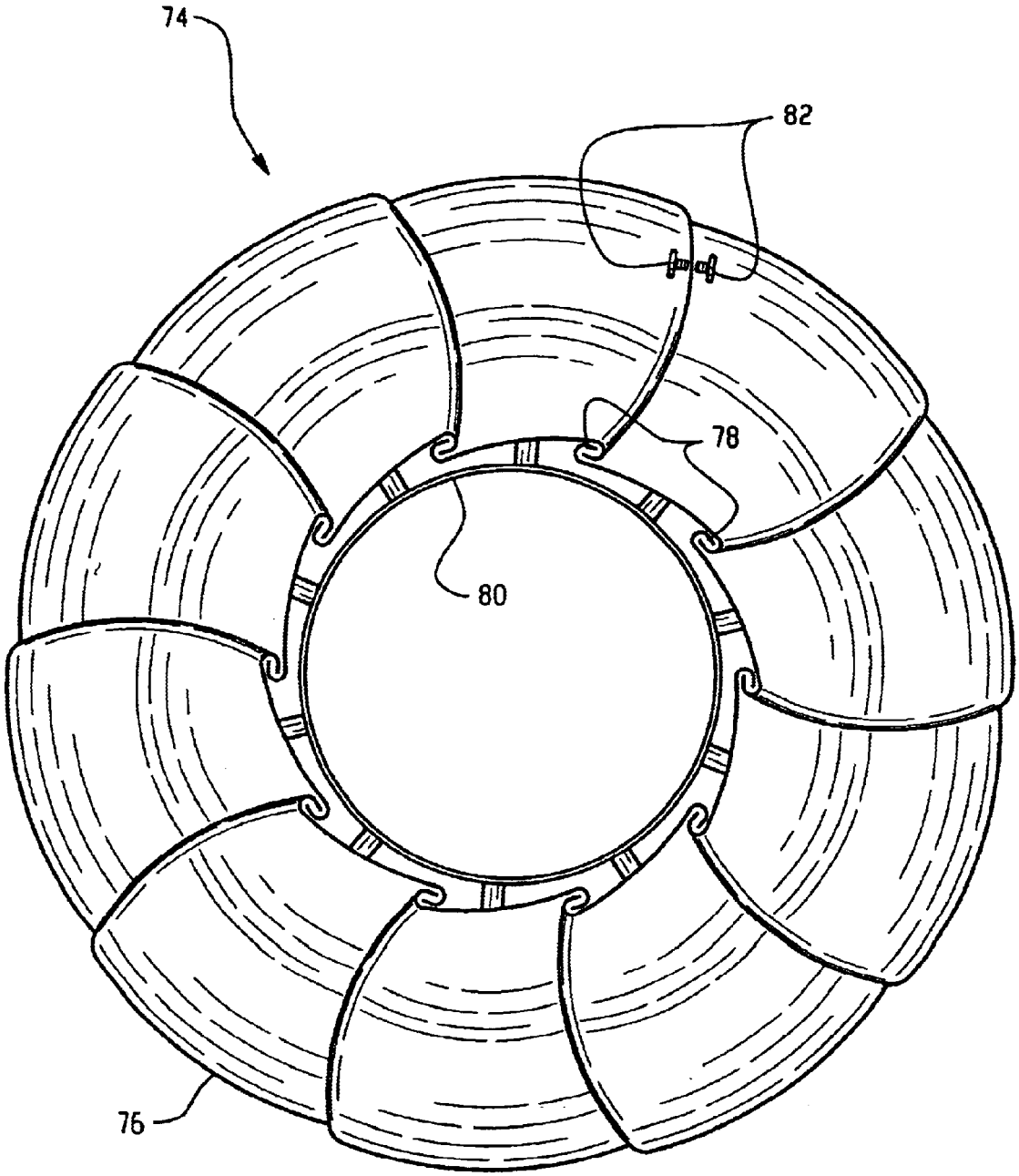
FIG. 5 is a top-down view of the embodiment of FIG. 4 in an open configuration.

In an alternate embodiment, with reference to FIG. 4, a light source 70 is fixed on a ballast housing 72. A reflector 74 includes a plurality of reflective elements 76. The reflective elements 76, as seen in a collapsed configuration in FIG. 4, are stackable, petal shaped segments of the reflector 74. With reference to FIG. 5, when the reflector 74 is in an open position, support elements 78 hold the reflective elements 76 in position relative to each other. The reflector 74 is opened by rotating a first element 76 around a track 80. When the first element has been translated approximately its own width around the track 80, the support element 78 of the first element couples with the support element 78 of a second element, towing the second element along the track 80. A support element of the second couples with a support element of the third, etc. The first element is translated around the track 80 until it abuts a last, preferably immobile element. A latch 82 is used to fixedly connect the first and last elements to keep the reflector in an open position.

Figure 6:
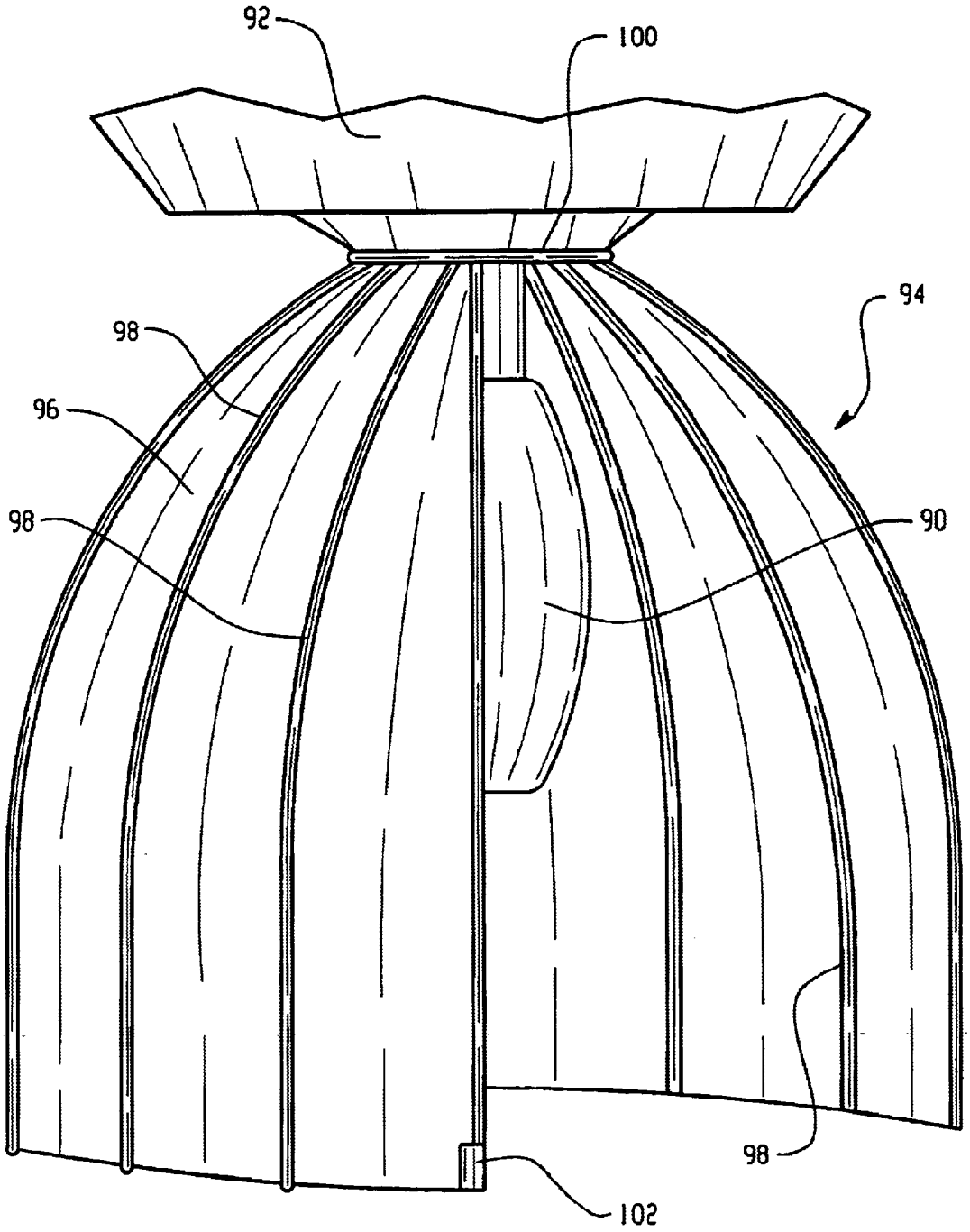
FIG. 6 is a sectional view of a rib-supported embodiment of the reflector, in accordance with one aspect of the present invention.

In an alternate embodiment of the present invention, with reference to FIG. 6, a light source 90 is carried on a ballast housing 92. A reflector 94 includes a reflective element 96 that is supported by a plurality of support elements 98 or ribs, extending from a track 100. The reflective element 96 is preferably a flexible material with a reflective coating on the interior of the reflector 94, facing the light source. The ribs 98 are attached at regular intervals along an outer surface of the reflective element 96.

In a collapsed orientation of the reflector 94 the ribs 98 are closely spaced together, with the reflective element 96 folded in-between the ribs 98. The reflector 94 is transitioned to an open orientation by translating a first rib around the track 100. The first rib tows the reflective element 96 and the remaining ribs 98 therewith, forming a surface with optically useful properties around the light source. A latch 102 secures the first rib with a preferably immobile last rib, holding the reflector 94 in its open orientation.

All of the above-disclosed embodiments provide an optically useful reflector that is collapsible into a form that occupies less space than its open orientation. The reflector is then capable of being packaged and shipped with the ballast housing, or packaged and shipped with multiple copies of itself. If the reflector and ballast housing are shipped together, the reflector can be pre-attached to the ballast housing, leaving the consumer little or no manipulation of the product aside from taking the product out of the box.

Figure 7:
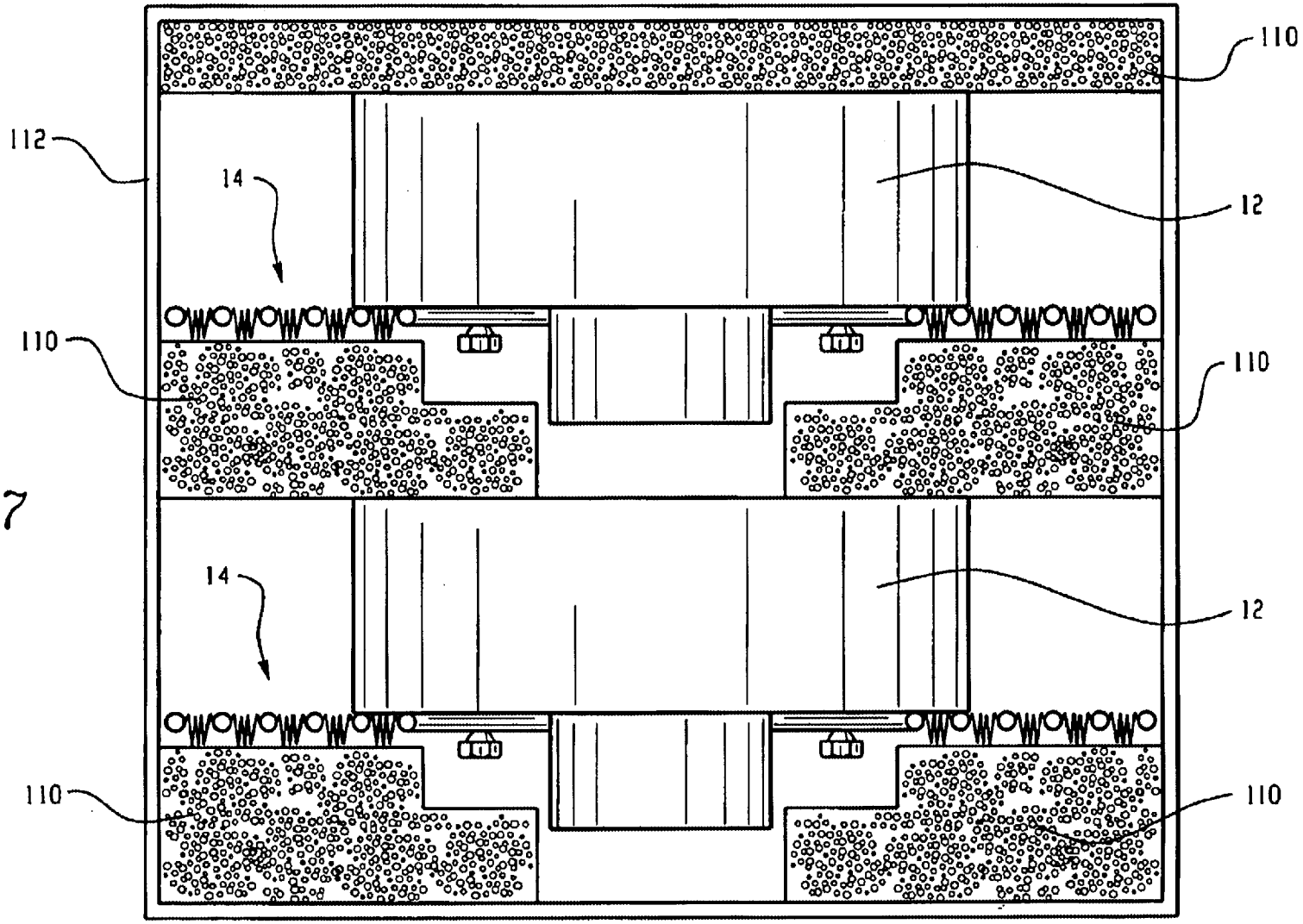
FIG. 7 is a depiction of multiple reflectors of FIG. 1 packaged into a shipping container.
Figure 8:
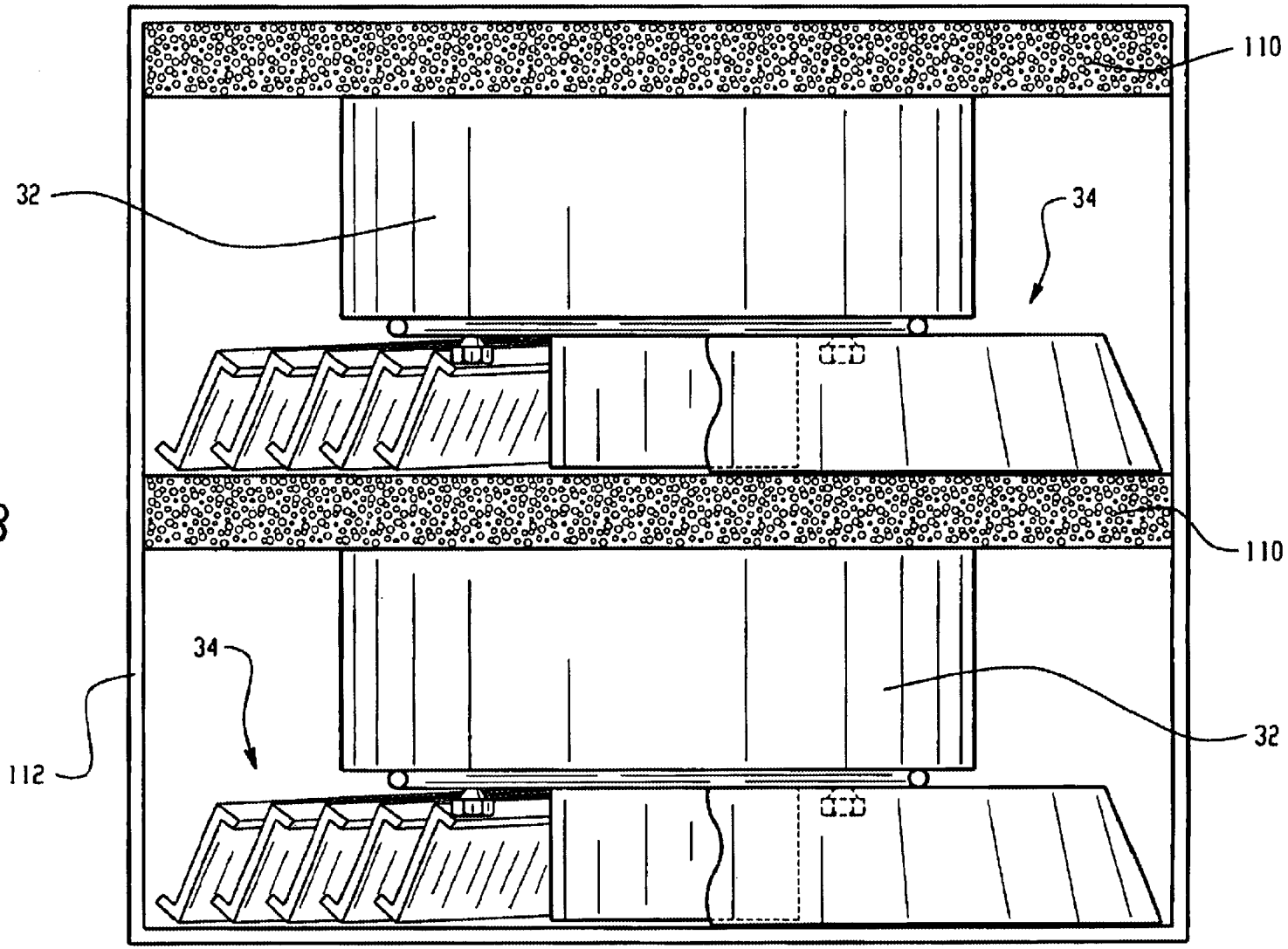
FIG. 8 is a depiction in partial section of multiple reflectors of FIG. 2 packaged into a shipping container.

The ballast housing can be packaged and shipped with the reflector pre-attached, as illustrated in FIGS. 7 and 8. Preferably, the ballast housing 12, 32 and the reflector 14, 34 together occupy little room over and above what the ballast housing occupies alone. Preferably, the ballast housing 12, 32 and reflector 14, 34 are packaged without the light source 10. This reduces occupied space and lessens the sensitivity of the package to impact. Packaging insulation 110 is used to protect the ballast housings during shipment, as well as to prevent physical contact between ballast housings. The packaging insulation can be any of well known insulation devices, such as Styrofoam peanuts, Styrofoam blocks, air bags, bubble wrap, and others. The ballast housings 12, 32, reflectors, and shipping insulation 110 are packaged into a shipping container 112, one preferably selected for its safety and security.

The preferred packaging method, in addition to providing added space in shipping containers, and protection of the lighting fixtures, lessens the need for assembly by the consumer. In the embodiments shown in FIGS. 7 and 8, the container 112 lid is opened, any packaging material 110 on top is removed, and the lighting assembly is lifted straight upwards by the ballast housing 12, 32. Gravity extends the reflector 14, 34 as the ballast housing 12, 32 is lifted from the container. At this point, the light source 10 is attached to the ballast housing 12, 32 and the lighting assembly is ready to be hung and connected to a power supply.

Alternately, instead of shipping multiple assembled fixtures in the same shipping container, the ballast housing 12, 32 and reflector 14, 34 can be shipped separately. The preferred embodiment has been described using a detachable reflector. It is to be understood that a thermoplastic seal or other permanent attachment means can be utilized to permanently attach the reflector 14, 34 to the ballast housing 12, 32. It is to be understood, that although packaging has been described in detail with reference to the first two embodiments, similar packaging is applicable to the remainder of the embodiments.

Aspects of the present application have been described with reference to preferred embodiments. Modifications and alterations will occur to others upon a reading and understanding of the preceding detailed description. It is intended that the concepts of the present invention be construed as including all such modifications and alterations insofar as they come within the scope of the appended claims or the equivalents thereof.

What is claimed is:

1. A lighting fixture comprising:

a ballast housing;

a light source carried on the ballast housing:

a collapsible reflector fixedly attached to the ballast housing, wherein the collapsible reflector includes:

at least one reflective element that includes a sheet of reflective material for focusing and re-directing light emanating from the light source at least one support element that includes a spiral wound spring for aiding the retention of an optically useful shape of the at least one reflective element; and, at least one fastener for fixedly attaching the collapsible reflector to the ballast housing.

2. A lighting fixture comprising:

a ballast housing;

a light source carried on the ballast housing;

a collapsible reflector fixedly attached to the ballast housing, wherein the collapsible reflector includes:

at least one reflective element that includes at least one spirally wound section for focusing and re-directing light emanating from the light source;

at least one support element that includes hook-shaped latches at transverse peripheries of the spirally wound section for aiding the retention of an optically useful shape of the at least one reflective element; and, at least one fastener for fixedly attaching the collapsible reflector to the ballast housing.

3. The lighting fixture as set forth in claim 2, wherein the spirally wound section is biased toward an open, un-collapsed configuration.

4. The lighting fixture as set forth in claim 2, wherein the spirally wound section includes a thin sheet of one of aluminum, steel, and a material capable of being finished with a reflective coating, the thin sheet being between 0.05 and 0.10 cm thick.

5. The A lighting fixture the comprising:

a ballast housing;

a light source carried on the ballast housing;

a collapsible reflector fixedly attached to the ballast housing, wherein the collapsible reflector includes:

at least one reflective element that includes a sheet of reflective material for focusing and re-directing light emanating from the light source;

at least one support element that includes a plurality of ribs to which the reflective element is attached at regular intervals for aiding the retention of an optically useful shape of the at least one reflective element: and, at least one fastener for fixedly attaching the collapsible reflector to the ballast housing.

6. The lighting fixture as set forth in claim 5, further including:

a rib channel in which the ribs are slideably attached to the ballast housing, the rib channel allowing radial translation of the ribs while preventing rotation of the ribs.

7. The lighting fixture as set forth in claim 6, further including:

a lower edge rib coupler for holding the reflective surface in an open position that couples a first rib to a last rib after the first rib has been rotated substantially 360° around the ballast housing.

8. A method of packaging a reflector used in conjunction with high intensity discharge ballast housings comprising:

collapsing the reflector into a collapsed form, the collapsed form occupying less space than an expanded form of the reflector;

inserting the collapsed reflector into a shipping medium, there being substantial space left in the shipping medium, when compared to space available when the collapsible reflector is in an uncollapsed state;

inserting a ballast housing into the shipping medium, occupying at least a portion of the space in the shipping medium fixedly attaching the reflector to the ballast housing; and sealing the shipping medium, whereby the shipping medium may be shipped and opened, the ballast housing removed, and the reflector expanded and hung without additional assembly.

9. The method as set forth in claim 8, further including:

inserting additional collapsed reflectors into the shipping medium, substantially filling the space in the shipping medium.

10. The method as set forth in claim 8, further including:

permanently attaching the reflector to the ballast housing.

11. The method as set forth in claim 10, further including:

using the reflector in conjunction with a high intensity discharge lamp, the reflector being capable of withstanding temperatures up to 500° C. of heat that the lamp generates.

* * * * *